United States Patent [19]

Watson et al.

[11] 4,265,589

[45] May 5, 1981

[54] METHOD AND APPARATUS FOR SURGE DETECTION AND CONTROL IN CENTRIFUGAL GAS COMPRESSORS

[75] Inventors: Thomas E. Watson, Staunton; Paul R. Smallwood, Jr., Grottoes, both of Va.

[73] Assignee: Westinghouse Electric Corp., Pittsburgh, Pa.

[21] Appl. No.: 49,686

[22] Filed: Jun. 18, 1979

[51] Int. Cl.[3] ..... F01D 21/12

[52] U.S. Cl. ..... 415/47; 415/118

[58] Field of Search ..... 415/1, 11, 27, 28, 47, 415/118; 60/39.28, 39.29; 73/116

[56] References Cited

U.S. PATENT DOCUMENTS

| | | | |
|---|---|---|---|
| 2,442,049 | 5/1948 | Lee | 123/119 |
| 2,470,565 | 5/1949 | Loss | 415/11 |
| 2,696,345 | 12/1954 | Hopper | 415/47 |
| 2,970,435 | 2/1961 | Winters et al. | 60/39.29 |
| 2,985,107 | 5/1961 | Anderson | 415/47 |
| 3,006,145 | 10/1961 | Sobey | 60/39.29 |
| 3,362,624 | 1/1968 | Endress | 415/1 |
| 3,555,844 | 1/1971 | Fleckenstein et al. | 62/217 |

*Primary Examiner*—Louis J. Casaregola
*Attorney, Agent, or Firm*—E. C. Arenz

[57] ABSTRACT

A centrifugal gas compressor having a shrouded rotatable impeller 14 in an impeller chamber 40, and provided with capacity control vanes 30 and a diffuser passage 18 throttle plate 38, is provided with surge control means including a thermistor 50 which senses a temperature rise beyond a predetermined value in the impeller chamber and exterior of the gas flow path through the impeller, and through relay means such as 52, 58 electrically connected to the thermistor 50 operates to change the compressor operation to a nonsurging condition.

8 Claims, 4 Drawing Figures

METHOD AND APPARATUS FOR SURGE DETECTION AND CONTROL IN CENTRIFUGAL GAS COMPRESSORS

BACKGROUND OF THE INVENTION

A surge condition is a violent instability condition (typically following an incipient surge or stall condition) which occurs in turbo compressors such as axial flow and centrifugal compressors. The condition is well known to those versed in the art and its onset depends on both the volumetric flow rate and the pressure ratio to which the compressor is subjected. Different types of turbo compressors have differing surge characteristics, but all are subject to the problem.

The surge condition can be caused by anything which either raises the discharge pressure, lowers the suction pressure, or reduces the gas flow to the compressor. In the art with which we are most familiar, most surging problems are caused by poor maintenance, failure of system components (such as cooling tower fans typically used with centrifugal compressor chiller packages), greatly over-sized units, or simple human errors such as failure to open a valve. When a compressor component fails from prolonged surging, the cause is not always easily determinable. However, in our experience, machines that have a history of repeated failures of bearings and impellers are usually found to have had surge problems. Thus, we believe that the provision of a low cost effective surge protection and control device would significantly reduce warranty cost and improve the reliability of units subject to surge.

DESCRIPTION OF THE PRIOR ART

To our knowledge a number of anti-surge control schemes are in current use.

One scheme is to monitor vibrations of the compressor by mounting a vibration detector on or near the compressor to sense vibration set up by the compressor in a surge condition. Such a scheme may be effective with some compressors and systems, but our experience with centrifugal refrigerant compressors is that these compressors can be in a surge condition with very little vibration experienced. Thus, a vibration detector would have to be extremely sensitive to be effective, and there would also be the problem of false surge indications due to vibrations coming from other sources, such as the transients experienced in start-up of the compressor.

Another monitoring arrangement is that in which the flow and pressure differences are monitored, such arrangements commonly being used in the chemical and petroleum industries. In such arrangements, the compressor volumetric flow, the inlet pressure, and the discharge pressure are sensed. These variables are processed in a controller such as a computer or microprocessor which actuates program anti-surge strategies to alleviate the surge conditions. Such systems are relatively complicated and expensive.

An apparently low cost variation of such an arrangement is disclosed in U.S. Pat. No. 3,555,844 which relates to the same general type of centrifugal compressor with which we are concerned in that it is provided with capacity control means. In the approach of that patent, the assumptions are made that volumetric flow is proportional to the capacity control positions, and that the inlet pressure to the compressor is fixed by the leaving evaporator water temperature in the system with which the compressor is connected. It is our belief that the system is not totally adequate because the assumptions are only true if the system is, among other things, properly charged with refrigerant, the evaporator water flow rate is not changed, no oil is lost to the evaporator, there is no fouling in the evaporator tubes and the refrigerant feed device is operating properly.

Another arrangement for controlling surge is to detect an incipient surge upstream of the impeller by detecting the temperature gradient of separate thermocouples at that location. Such an arrangement is disclosed in U.S. Pat. No. 2,696,345 in which it is pointed out that at that location any major surging is preceded by an initial recirculation and the temperature gradient at radially spaced locations is used to indicate an onset of surge.

That same patent teaches the concept of using thermocouples on the discharge side of an axial flow compressor and arranged to measure the temperature gradient between the thermocouples. Also, U.S. Pat. No. 2,442,049 discloses the use of temperature sensitive resistance elements in both the inlet and the outlet of a supercharger as a part of a system for controlling fuel-air ratios for an internal combustion engine.

It is our view that none of these arrangements are wholly satisfactory for application to the type of device with which we are particularly concerned, which is a centrifugal refrigerant compressor of the type having provision for capacity control and in which the diffuser passage space is controlled in accordance with the suction inlet flow.

SUMMARY OF THE INVENTION

In accordance with the method of the invention, a surge condition is detected in a centrifugal gas compressor by sensing a temperature rise beyond a predetermined value in a space in the impeller chamber of the compressor which is exterior of the flow path of gas through the impeller, and is at a location between the general area of the impeller gas inlet impeller and gas outlet.

This method is carried out in a centrifugal gas compressor which includes a rotatable impeller with a front central inlet and a peripheral outlet and having a gas flow path defined between the inlet and outlet, with casing means defining an impeller chamber in which the impeller is situated, the compressor having capacity control means in its inlet passage space for controlling the degree of open area of the passage space, and temperature sensing means is carried by the casing means and exposed to a space in the impeller chamber exterior of the flow path through the impeller and in a location which is downstream of the capacity control means and upstream of the outlet of the impeller, the temperature sensitive means being operable in response to a temperature rise in the space to which is exposed beyond a predetermined value corresponding to a surging condition of the compressor to change the operating condition of the compressor away from the surging condition.

DRAWING DESCRIPTION

DESCRIPTION OF THE PREFERRED EMBODIMENTS

Figure 1:
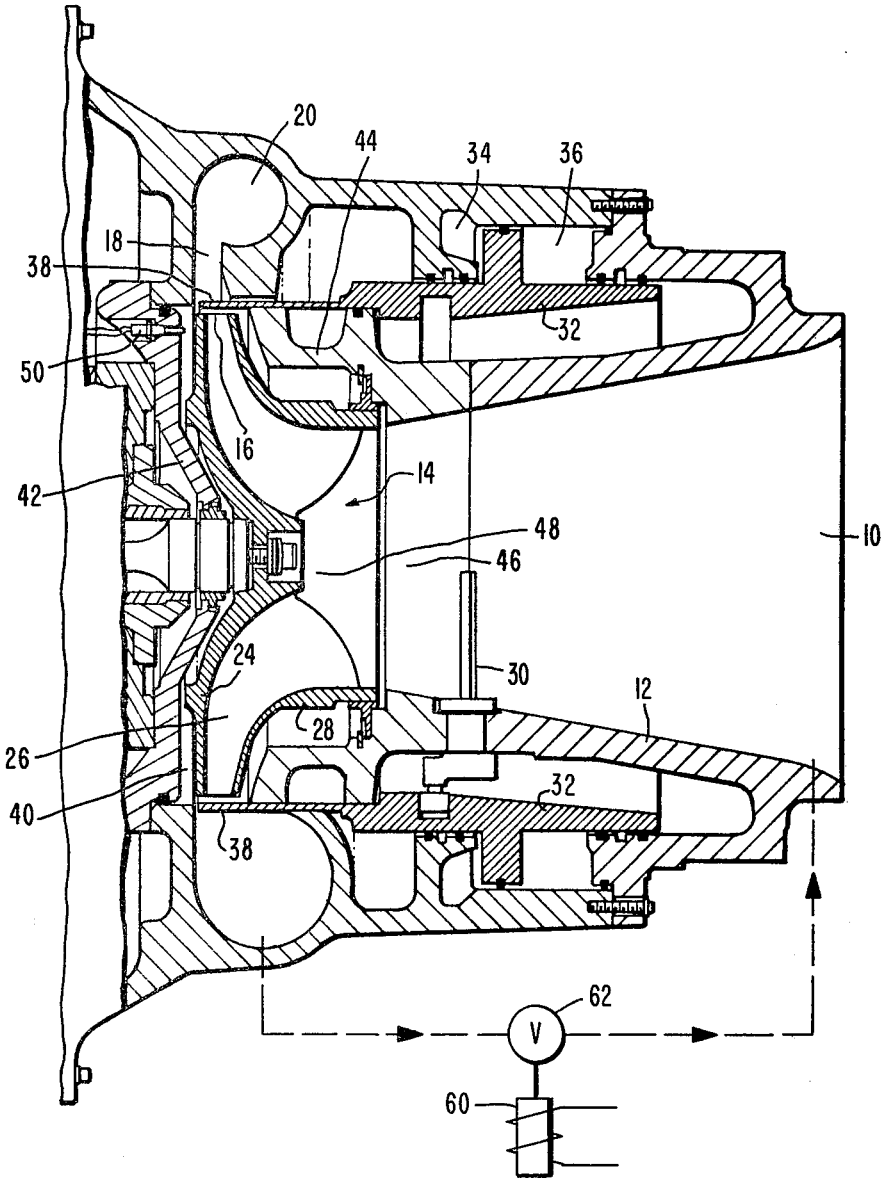
FIG. 1 is a partly broken side view, mostly in vertical section, of a compressor including an arrangement according to the invention, and including a schematic representation of a hot gas recirculation circuit.
Figure 2:
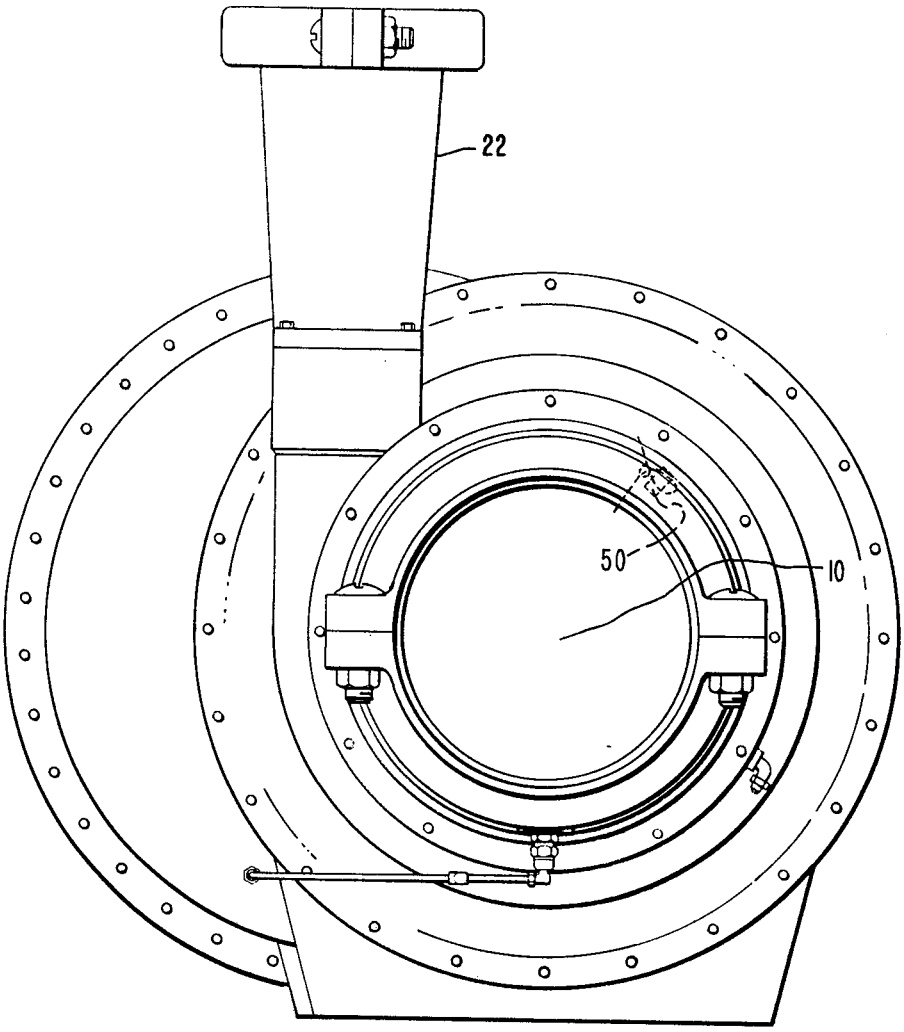
FIG. 2 is an end elevational view of the compressor as viewed from the right side of FIG. 1, this view omitting those parts which would be seen interiorly of the open intake end.

Referring to FIGS. 1 and 2, a centrifugal gas compressor of one type to which the invention may be applied for example, has a converging inlet passage defined by the converging annular wall 12. Refrigerant suction gas is drawn through this passage by the rotating impeller 14 which receives the gas in its central inlet, compresses the gas and discharges it from the peripheral outlet 16 of the impeller into an annular diffuser passage 18. This passage communicates with the gas collecting scroll 20 which in turn passes the gas into the discharge nozzle 22 (FIG. 2). The scroll 20 cross-sectional area progressively increases in the direction of gas flow toward the discharge nozzle while the depth of the diffuser passage 18 is of progressively decreasing depth in that same direction.

The impeller illustrated is of a closed shroud type of construction and as such includes a back plate 24, spirally extending blades 26 and the front shroud 28. Thus, the gas flow path through the impeller is from its central inlet to peripheral outlet and is defined between the back plate 24 and the front shroud 28.

The compressor shown is provided with a capacity control system for internal unloading of the compressor. The compressor capacity is varied by positioning a series of compressor suction inlet guide vanes (only one 30 being shown and it being in a closed position). Positioning of the guide vanes is controlled by movement of an annular piston 32 whose position in turn is controlled by oil volume in two annular oil chambers 34 and 36, the flow of oil into one and out of the other chamber and vice versa being accomplished by an arrangement such as is disclosed in U.S. Pat. No. 3,350,897.

The compressor illustrated is also provided with a throttle plate, or what is sometimes called a diffuser block 38, which is integral with the piston 32 and accordingly moves concurrently with the movement of the inlet guide vanes 30. As the compressor capacity is reduced, the throttle plate moves into the diffuser passage to match the volume of this passage to the gas flow being controlled by the inlet guide vanes. In FIG. 1, both the inlet guide vanes 30 and the throttle plate 38 are shown in a substantially closed position. In the opposite position, the vane would be rotated to a position generally parallel to the gas flow and the throttle plate 38 would be out of the diffuser passage. Inlet guide vanes for capacity control and movable diffuser blocks are well known in the art, U.S. Pat. No. 3,289,919 being an example of a patent providing some detail as to one arrangement for a movable diffuser block.

The impeller 14 is located in what is herein called the impeller chamber 40 defined at the back by a back wall 42 which faces the back plate 24 of the impeller, and forward wall means 44 which generally face the shroud 28 of the impeller and may be said to terminate centrally to define an inlet passage space 46 upstream of the central inlet area 48 of the impeller. The back wall and forward wall means are those parts of the casing means of the compressor which define the impeller chamber.

In accordance with our invention, temperature sensing means is carried by the casing means and exposed to a space in the impeller chamber exterior of the flow path of gas through the impeller. In what is believed to be the currently-preferred way of carrying out the invention, the temperature sensing means comprises a thermistor 50 with a positive temperature coefficient. Our currently preferred location for the thermistor is closely adjacent the peripheral outlet 16 of the impeller. One thermistor which has performed satisfactorily for our purposes on one particular compressor is available from P.E.T., Inc. as part No. TPB-010685A.

The use of a thermistor as the temperature sensing means is preferred because of its response characteristics, sensitivity, relatively low cost and ease of mounting, although any fast-response temperature sensor could be used rather than a thermistor. A thermistor also has the additional advantage that if it is desirable to provide a hot-gas recirculation arrangement, the character of change in resistance of the thermistor with temperature changes can be useful in first changing the operating position of a compressor away from a surging condition rather than providing only for a shut-down of compressor operation.

The underlying concept of our invention is based upon our discovery that in a surge condition of a compressor, the temperature in the impeller chamber rapidly rises above the normal operating temperature. In tests upon one given compressor of a given size in which the normal operating temperature is approximately 100° F. (38° C.), the temperature rapidly rose to over 225° F. (107° C.) when the compressor was caused to surge. While the temperatures for normal operation and surging operation may differ with different size and type compressors, the principle is the same in cases.

The temperature rise occurring when the compressor is surging is caused by the increased heat produced by reduced compressor efficiency and the inability of the reduced gas flow to remove the heat. It will be appreciated from this also that the monitoring of temperature in the discharge, as contrasted to our arrangement, is not effective because the discharge temperature of a refrigerant compressor as shown will actually go down when the compressor is in surge, since the flow to the discharge is basically stopped.

Figure 3:
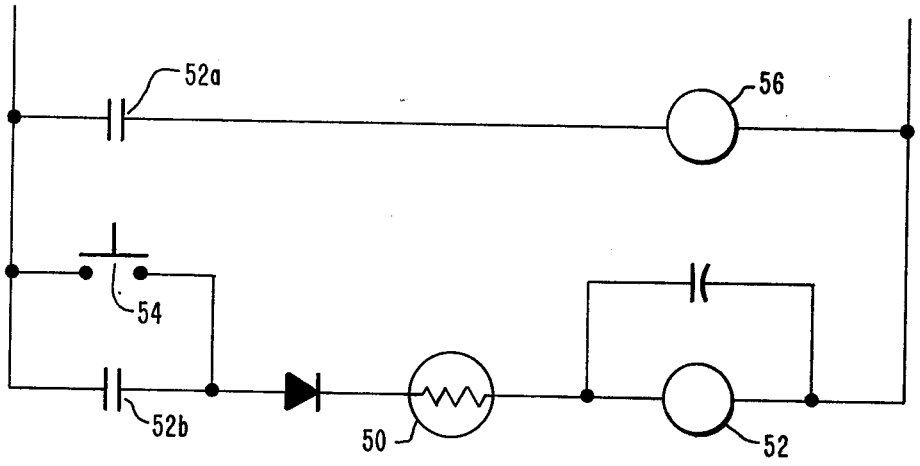
FIG. 3 is a schematic illustration of a control circuit which may be used for simply shutting down the compressor when a surge condition is detected.
Figure 4:
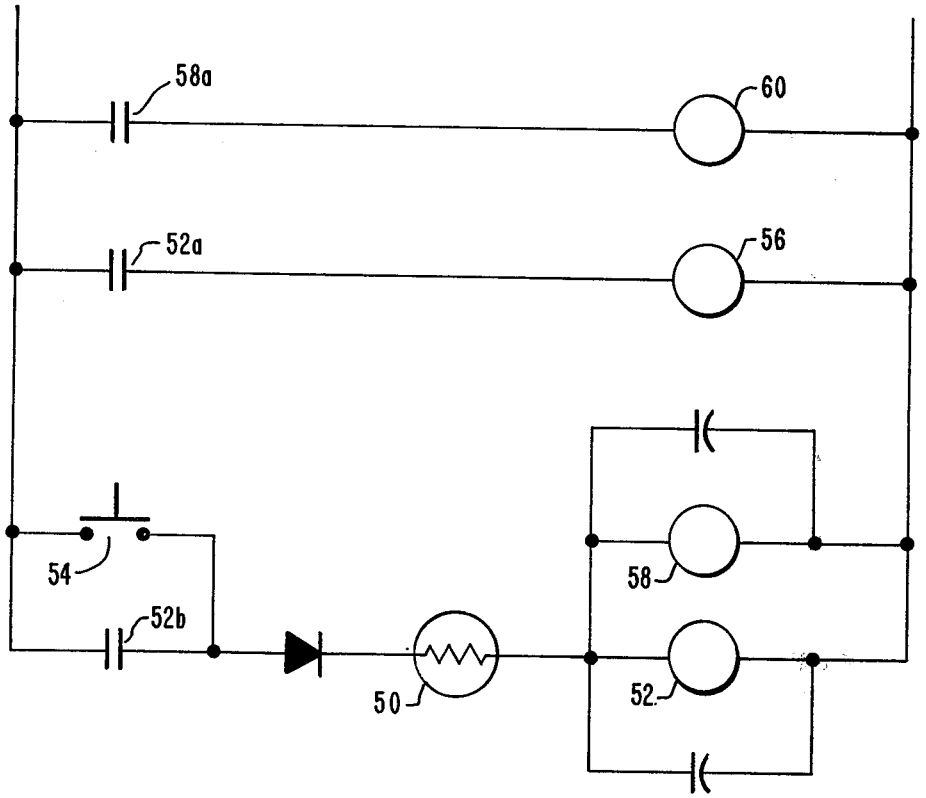
FIG. 4 is a schematic illustration of another control circuit including means for controlling hot gas recirculation in a surging condition.

Two circuit arrangements which may be used for surge detection and control are illustrated in FIGS. 3 and 4, these circuits only including those components which are used directly in connection with surging.

In FIG. 3, the thermistor 50 is in series with a direct current sensitive relay 52 which includes the normally open relay actuated switches 52*a* and 52*b*. The switch 52*b* is in parallel with a reset switch 54, both of which are in series with the thermistor 50 and relay coil 52. The relay control switch 52*a* is in series with a compressor operation control relay 56 which, when deenergized, shuts down compressor operation. In normal operation, the resistance of the thermistor 50 is sufficiently low that the relay 52 remains energized and accordingly its controlled switches 52*a* and 52*b* are closed permitting compressor operation and continued energization of the relay 52. When the temperature in the impeller chamber at the thermistor location rises sufficiently to indicate a surging condition, the resistance of the thermistor correspondingly rises so that the reduced voltage drop across the relay 52 causes its deenergization and the opening of its control switches 52*a* and 52*b*, which in turn results in shut-down of the compressor by deenergization of the relay 56.

In the arrangement of FIG. 4, a number of the parts of the circuit are the same and perform the same basic functions. However, an additional relay 58 is provided in parallel with the relay 52, the relay 58 having a control switch 58*a* which is in series with a solenoid 60 controlling a valve 62 in the schematically illustrated hot gas recirculation circuit shown in FIG. 1. The relay 58 is designed relative to the relay 52 to be deenergized at a higher voltage than that at which the relay 52 is deenergized. Thus, as the temperature in the impeller chamber rises and is sensed by the thermistor 50, the increasing voltage drop across the thermistor because of its increasing resistance will result in the relay 58 first being deenergized, which in turn will result in closure of switch 58*a* and energization of solenoid 60 to open valve 62 to recirculate hot gas from the discharge back to the inlet of the compressor. If this is inadequate to alleviate the surging condition, the further rise in temperature in the impeller chambers sensed by the thermistor and a further voltage drop across the thermistor will result in the subsequent deenergization of the relay 52 and a shut down of the compressor as was described in connection with FIG. 3.

We claim:

1. A centrifugal gas compressor comprising:

a rotatable impeller having a front central inlet, and a peripheral outlet, and having a gas flow path defined between said inlet and outlet;

casing means including wall means defining an impeller chamber in which said impeller is situated and further defining an inlet passage space upstream of said central inlet of said impeller;

capacity control means in said inlet passage space for controlling the degree of open area of said passage space; and surge control means including temperature sensing means carried by said casing means and exposed to a space in said impeller chamber exterior of said flow path through said impeller, and in a location generally downstream of said capacity control means and generally upstream of said peripheral outlet of said impeller, said surge control means being operable, in response to said temperature sensitive means responding to a temperature rise in said space to which it is exposed beyond a predetermined value which corresponds to a surging condition of said compressor, to change the operating condition of said compressor to a non-surging condition.

2. A compressor according to claim 1 wherein:

said temperature sensing means comprises thermistor means carried by said casing means and exposed to the generally annular space defined between the casing means and the back of said impeller.

3. A compressor according to claim 2 wherein:

said thermistor is located closely adjacent the peripheral outlet of said impeller.

4. A compressor according to claim 1 including:

diffuser passage means radially outwardly from said impeller peripheral outlet; and diffuser passage throttle means operable in conjunction with said capacity control means.

5. A compressor according to claim 1 wherein:

said surge control means includes relay means responsive to one voltage level to permit continued operation of said compressor in a non-surging condition, another voltage level to effect hot gas recirculation, and a third voltage level to shut said compressor down.

6. A centrifugal gas compressor comprising:

a rotatable impeller having a backplate, a front central inlet, and a peripheral outlet, and having a gas flow path defined between said inlet and outlet;

casing means defining an impeller chamber in which said impeller is situated including a back wall facing said backplate of the impeller and defining therewith a generally annular space, and including forward wall means generally facing the forward side of said impeller around said central inlet and terminating centrally to define an inlet passage space upstream of said central inlet of said impeller;

capacity control means in said inlet passage space for controlling the degree of open area of said passage space;

a diffuser passage radially outwardly of said impeller peripheral outlet;

throttle means in said diffuser passage;

surge control means including temperature sensing means carried by said casing means and exposed to a space in said impeller chamber exterior of said flow path through said impeller, and in a location generally downstream of said capacity control means and generally upstream of said throttle means, said surge control means being operable, in response to a temperature rise in said space to which said temperature sensitive means is exposed beyond a predetermined value which corresponds to a surging condition of said compressor, to change the operating condition of said compressor away from said surging condition.

7. A compressor according to claim 6 wherein:

said temperature sensing means comprises thermistor means carried by said back wall of said casing means and exposed to said generally annular space between said back wall and said impeller backplate.

8. A compressor according to claim 7 wherein:

said thermistor is located closely adjacent the peripheral outlet of said impeller.

* * * * *